US008453660B2

(12) United States Patent
Herriger et al.

(10) Patent No.: US 8,453,660 B2
(45) Date of Patent: Jun. 4, 2013

(54) FOLDABLE POCKET UMBRELLA

(75) Inventors: Thomas Herriger, Solingen (DE); David Haythornthwaite, Xiamen (CN)

(73) Assignee: Präsenta Promotion International GmbH, Solingen (DE)

( * ) Notice: Subject to any disclaimer, the term of this patent is extended or adjusted under 35 U.S.C. 154(b) by 21 days.

(21) Appl. No.: 13/269,294

(22) Filed: Oct. 7, 2011

(65) Prior Publication Data

US 2012/0222713 A1 Sep. 6, 2012

(30) Foreign Application Priority Data

Mar. 1, 2011 (DE) ..... 20 2011 003 388 U
Mar. 9, 2011 (EP) ..... 11001960

(51) Int. Cl.
*A45B 19/00* (2006.01)

(52) U.S. Cl.
USPC ..... 135/25.41; 135/34.2

(58) Field of Classification Search
USPC ..... 135/25.4, 25.41, 34.2, 19.5
See application file for complete search history.

(56) References Cited

U.S. PATENT DOCUMENTS

| | | | | |
|---|---|---|---|---|
| 868,326 | A | 10/1907 | Casale | |
| 892,813 | A | 7/1908 | Dolles | |
| 1,592,723 | A * | 7/1926 | Chism | 135/26 |
| 1,885,968 | A | 11/1932 | Wedemann | |
| 2,091,676 | A | 8/1937 | Fliegner | |
| 2,172,549 | A * | 9/1939 | Solomon | 135/20.2 |
| 3,730,199 | A * | 5/1973 | Thur | 135/25.4 |
| 3,744,502 | A * | 7/1973 | Weber | 135/25.4 |
| 4,456,023 | A | 6/1984 | Fujihashi | |
| 4,821,756 | A * | 4/1989 | England | 135/19.5 |

FOREIGN PATENT DOCUMENTS

| | | | |
|---|---|---|---|
| AT | 006 249 | U1 | 7/2003 |
| DE | 618 174 | | 9/1935 |
| DE | 625 783 | | 2/1936 |
| DE | 1814 204 | | 9/1970 |
| DE | 2 137 261 | | 2/1973 |
| DE | 2 307 706 | | 8/1973 |
| DE | 91 00 505.1 | U | 5/1991 |
| DE | 40 08 212 | A1 | 9/1991 |
| DE | 43 14 650 | A1 | 11/1994 |
| DE | 195 05 707 | A1 | 3/1996 |
| DE | 195 25 409 | A1 | 7/1996 |
| DE | 201 19 736 | U1 | 2/2002 |
| DE | 102 17 280 | A1 | 6/2003 |
| DE | 102 53 797 | A1 | 5/2004 |
| DE | 20 2007 012276 | U1 | 12/2007 |
| EP | 0 495 472 | A2 | 7/1992 |
| GB | 311 265 | | 8/1929 |
| GB | 365 954 | | 1/1932 |
| GB | 2 320 893 | A | 7/1998 |
| GB | 2 403 904 | A | 1/2005 |
| JP | 5123211 | A | 5/1993 |
| JP | 2000070024 | A | 3/2000 |
| JP | 2002291509 | A | 10/2002 |
| WO | WO 97/48303 | | 12/1997 |
| WO | WO 2009/039939 | A1 | 4/2009 |

* cited by examiner

*Primary Examiner* — Noah Chandler Hawk
(74) *Attorney, Agent, or Firm* — Henry M. Feiereisen, LLC; Ursula B. Day

(57) ABSTRACT

A foldable pocket umbrella is proposed that includes a handle cover and a support element of a truncated cone-shaped tripod element having air ducts for ventilation of the interior of a handle cover. The support and a three point bearing achieves optimal conditions conferring minimal frictional losses between support element and inner wall of the handle cover and resilient stability to the umbrella.

10 Claims, 6 Drawing Sheets b)

b)

FOLDABLE POCKET UMBRELLA

CROSS-REFERENCES TO RELATED APPLICATIONS

This application claims the priority of German Patent Application Serial No. 20 2011 003 388.0, filed Mar. 1, 2011 and European Patent Application Serial No. 11001960, filed Mar. 9, 2011 pursuant to 35 U.S.C. 119(a)-(d), the subject matter of which is incorporated herein by reference.

BACKGROUND OF THE INVENTION

The invention relates to a foldable umbrella comprising an additional further functionality, such as umbrella cover—in particular a compact pocket umbrella comprising a handle cover and a support for the rotatable and lockable main rods with double bearings.

Due to the long history of umbrellas, an extensive and manifold collection of corresponds patent literature has accumulated. Anything that has to do with a lining and with folding was developed under the keyword "foldable umbrella" or "collapsible umbrella" in an application-specific manner. The following extensive field of corresponding applications can thus be found, for example

- collapsible pocket umbrella comprising a reinforced roof rod frame
- fully-automatic foldable umbrella
- automatic umbrella
- foldable umbrella-type clothes drier
- mobile umbrella canopy for events
- wind-resistant foldable umbrella
- umbrella, which can be opened and folded easily comprising a reduced volume
- foldable umbrella comprising a city map
- suspension device for foldable umbrella
- chair comprising a holder and umbrella
- insect protection umbrella
- bicycle comprising a holder and umbrella
- holder comprising foldable sun protection
- holder and umbrella for strollers
- holder and umbrella for animals
- canopy device
- foldable and spreadable transport means
- foldable baby cart
- foldable umbrella as broadband antenna.

The following shall be limited to the functionality of the foldable pocket umbrella, even though technical components, modules and solution approaches can also be found in the applications of related disciplines.

The state of the art of foldable umbrellas comprising an additional further functionality, such as an umbrella cover comprising an umbrella handle and support for the telescopic tube shall be mentioned below; a plurality of types of foldable umbrellas comprising an additional further functionality, such as an umbrella cover comprising an umbrella handle, are known from the state of the art—depending on the application.

Austrian utility model AT 006 249 introduces a mini pocket umbrella, which, for being closed, is retracted into the umbrella handle as hollow body by means of a cord, which is guided in the center rods as opening and closing mechanism of the umbrella roof and which can be transported in coats and trouser pockets due its small volume. This pocket umbrella is ultra-light and extremely small. The main umbrella rods and the rods of the roof construction are embodied so as to be capable of being telescoped. After its use, the umbrella is retracted into the umbrella handle by means of the cord and is closed with the cover in a water-tight manner.

Disadvantages of the novelty according to the invention are that the main rods are supported in a single point in the base of the umbrella handle and that a used wet umbrella is retracted into the tightly closing umbrella handle and that the technical solution approach still requires a certain maturity.

German utility model DE 20 2007 012 276/International application WO 2009/039 939 introduces a foldable umbrella comprising an additional further functionality, such as an umbrella cover—in particular a compact pocket umbrella comprising a handle cover and a support for the telescopic tube. The handle cover, which is preferably embodied so as to be oval, is embodied such that it can accommodate the entire umbrella, which substantially consists of a stationary tube, a telescopic tube, a slide, roof rods and a lining, by means of folding and pushing together. A quick handling by the user is provided via an extractable handle, which is easily accessible and which is preferably also shaped as an oval and which is fixedly connected to the telescopic tube so as to be flush. By means of its tripod design and its tripod slide bearing, the support element provides stability to the arrangement in each position of the extracted telescopic tube. A ventilation of the interior, which is filled with the roof rods and the lining, is provided by means of the bilateral opening of the handle cover of the umbrella at the top and base side—on the top side by means of the resulting rotating slit between handle cover collar and extractable handle, and on the base side by means of narrow longitudinal slits in the base plate, which is preferably curved slightly outwardly, and an accumulation of moisture is prevented. The production of the handle cover in its oval shape, the engraved handle piece and the molded collar is relatively extensive and also necessitates an extractable handle, which is shaped like an oval; the ventilation slits on the base side must furthermore be considered. The support element must be carried out as a tripod due to the selected spatial geometries.

German published patent application DE 195 25 409 discloses a lockable and closable, preferably cylindrical plastic box as umbrella cover, which is preferably developed for two-wheelers and in particular for the shake-free and thus noise-free transport of the folded pocket umbrella. On the one side, the rigid cylinder box, which holds together the folded lining, which forms the roof of the umbrella, is closed by means of a circular base and encompasses a removable cover on the other side, which is connected to a toothed rack and which can be inserted and can be locked via a number/combination lock while holding the clamp-like frame fastening elements. A characteristic of the pocket umbrella is that its longitudinal expansion, including the umbrella handle, must be smaller than the closed box.

German patent specification DE 195 05 707 relates to a collapsible umbrella, the lining of which is supported by roof rods, which are arranged around the umbrella handle in a star-shaped manner. The roof rods are articulated in a pivotable manner on a crown, which can be displaced along the shaft of the umbrella and the upper end of which can be locked, and which, in the unfolded state of the umbrella, are supported by support rods, one end of which is articulated on the roof rods and other end of which is articulated on a slide, which can also be displaced and locked along the umbrella shaft. The closing and shortening of the umbrella takes place by means of collapsing the roof rods above the crown and by inserting the umbrella shaft between the collapsed roof rods. The characteristic of the arrangement is that the roof rods and the support rods are collapsed away from the user.

German published patent application DE 102 53 797 introduces an umbrella case comprising a drying function, the use of which is intended in a motor vehicle, wherein the umbrella accommodating case is connected to the interior heater of the vehicle or has its own heater with a controllable drying phase. On the one hand, the umbrella case, which is preferably embodied in a hollow-cylindrical manner, is to accommodate a dry umbrella, which can preferably be pushed together, or, on the other hand, a wet umbrella, which has been pushed together, for the purpose of drying. By means of guide ribs, which point radially inwardly, channels are formed between the cylindrical cover of the case and the inserted umbrella, with said channels being ventilated by air, which is fed in opposite to the umbrella insertion side, and which are to discharge the moisture of a wet umbrella lining. Instead of longitudinal guide bars, provision is alternatively also made for cross bars in the case of lateral air infeed. No statements have been made about the dimensioning of the novelty according to the invention with reference to climatic relationships.

German published patent application DE 102 17 208 describes a multi-functional umbrella and handle holder of a collapsible umbrella. The handle holder comprises a cylindrical tube section comprising guides, which extend on the inner wall in axial direction, for protecting against the rotation of the length of the folded umbrella accommodation, a hollow-cylindrical connecting ring connected in one piece to the tube section at the tube opening facing the roof crown, a cylindrical stationary base cover at the opposite tube end and a hollow-cylindrical connector fixedly applied thereto at the end of the lower main rods. Connecting ring and cover have lateral recesses at the location of the axial guides, so that the connector can be joined with groove-forming projections, which are attached at its outer side, in the axial guide as well as in the connecting ring as well as in the base cover so as to be flush with the cylinder. In addition, the connector has elastic snap-in elements, which engage with bore holes of the connecting ring when the umbrella is open as well as with similar bore holes of the base cover when the umbrella is folded so as to lock. In this respect, connecting ring and base cover form stops for the travel of the connector, which glides in the tube section in response to the handling of the umbrella.

When the umbrella rods are open, the main rods are connected to the handle holder via the connector, the connecting ring and the tube section as handle holder, so as to be secured against rotation; provision is not made for a second support bearing for the main rods.

European application EP 495 472/German utility model DE 91 15 108 and DE 91 00 505 introduce a case comprising an integrated pocket umbrella, which can be accessed from the outside. The novelty according to the invention provides for a flat case tube being installed in the cover of a briefcase with a small space requirement and behind the interior trim. A flat, rectangular pocket umbrella, which can be telescoped, is inserted into the cuboid tube so as to be capable of being disengaged. The handle of the umbrella is held in place by means of a lock in the tube; after disengaging the lock, the umbrella is released to the outside by means of a spring mechanism, which is introduced into the center rod of the umbrella. Umbrella and case are only conditionally dependent on one another—due to their configuration.

German published patent application DE 43 14 650 provides for a portable container comprising a case-shaped accommodation for additionally accommodating a pocket umbrella. So as to design all three objects, such as case-shaped accommodation, umbrella and/or container to have the smallest possible volume when not in use and so as to be able to carry them easily and simply or so as to be able to pocket them, respectively, but so as to be able to also have them in hand just as easily when it is necessary to use them, on the other hand, it is proposed for the container to have the shape of a rollable carrying bag or of a backpack comprising a case-shaped accommodation at one end, which runs at right angles to the side edges of the carrying bag or of the backpack, respectively.

In the case of the instant application, pocket umbrella and container are two independent devices.

German published patent application DE 40 08 212 deals with a foldable pocket umbrella comprising an umbrella lining, a foldable frame, which spreads out the umbrella lining in the open state, and a handle comprising the characteristic that the frame consists of an extendable rod—a telescopic rod—, spiral wires for spreading out the umbrella lining and the handle of a tube-shaped sleeve for accommodating the central rod, the spiral wires and the umbrella lining. At the outer edge of the umbrella lining, the spiral wires are guided by means of limiting draw strings, which—together with the spiral wires—end in a manual winding mechanism at the base of the accommodating sleeve. By activating the winding mechanism, the spiral wires and draw strings—including the umbrella lining and telescopic rod—are pulled into the accommodating sleeve.

No information is provided relating to the dimensioning of the accommodating sleeve.

German published patent application DE 23 07 706/Italian application IT 20 898 introduces a pocket umbrella of any type, such as a foldable, telescopic and/or cranesbill umbrella—comprising an installed cover, either for accommodating the umbrella in its folded state or as handle cover when the umbrella is spread out. The handle cover must be able to accommodate forces in the handle area, but can otherwise be made of another material, for instant a resilient or foldable or otherwise deformable material. Provision is made for a closure on the base side of the hollow-cylindrical handle cover, which is farthest away from the crown of the main rods and which also accommodates the lowermost section of the tube rods, which have a polygonal cross section, via a clamping location so as to be secured against rotation. A guide sheet, which moves with the main slide to the upper edge of the handle cover, runs in inside rails of the handle housing, which are attached diametrically.

The guide cover is rigidly guided within the handle cover by means of the polygonal tube rods and the lateral rails and tends to cant in response to even the slightest irregularities of the rods; a rotation of the umbrella is impossible.

German patent specification DE 21 37 261 discloses an umbrella, which can be shortened, which has a flat cross sectional shape when folded, at the headpiece of which, which encompasses two flanks, eight roof rods, which can be telescoped, are articulated in slits, wherein two roof rods in each case escape at the cross sides of the headpiece and at the auxiliary slide of which, which also encompasses two flanks, the auxiliary rods are articulated in slits in an analogous manner, with said auxiliary rods being connected on the other end in an articulated manner to the main rods, which are articulated at the main slide. Provision is not made for a container for the umbrella, which can be shortened.

German published, examined application DE 18 14 204 introduces a pocket umbrella comprising a handle, which can be shortened, and an umbrella surface, which is reinforced by means of ribs, which are arranged in a star-shaped manner, wherein the ribs consist of bendable tubes, which are closed at the ends, and the inner ends of which lead to a central chamber, which is formed by an upper and a lower wall, and which encompasses a displaceable air inlet valve, and the multi-part umbrella shaft is screwed to the air inlet valve.

An umbrella case is not introduced; the size of the folded umbrella is predetermined by the largest partial length of the umbrella shaft.

German patent specification DE 62 57 83 introduces an umbrella without rods, the umbrella shaft and umbrella roof rods of which can be telescoped and can be inserted into the umbrella handle, wherein the activation for the umbrella rods and for the guide rings for the rods are also accommodated in the umbrella handle. The umbrella shaft, which is pushed together, as well as the roof rods of the roof rods, which are pushed together, are located in the handle housing arranged in that one circular disk, which is stationary, and one which is supported so as to be rotatable or displaceable, is in each case located above the closed base of the handle housing, with said disk being able to accommodate the ends of the roof rods by means of truncated cone-shaped axial bore holes and which causes—by means of a center pin of the main rods—the displaceably supported disk to lock the roof rods in response to the closing operation. To open the umbrella, umbrella and roof rods are initially telescoped and the center pin is pulled out of its anchoring by means of the last axial movement, which then releases the closing mechanism for the roof rod ends.

The hollow-cylindrical umbrella handle consists of a number of guide sleeves, which corresponds to the number of roof rods, for accommodating them as well as of a guide cylinder supported in the center for accommodating the main rods. The lining for the roof is designed so as to be removable and must be supported outside of the umbrella handle housing—even in the wet state. In its inserted state, the umbrella closes tightly and is two-point supported in its extended state; an interior ventilation of the umbrella handle is not provided.

German patent DE 61 81 74 encompasses a foldable umbrella, which can be shortened and which can be completely inserted into the umbrella handle, comprising two-point, fixed and radially supported main rods, wherein in a first state, two sleeve halves—placed on top put over from below—which are screwed together in one piece and which have different diameters, form the hollow umbrella handle and are closed in a second state, in which the sleeve halves are screwed relative to one another so as form a hollow body and accommodate the rods and the lining. In the closed base of the sleeve half, which has the smaller diameter, a guide rod is rigidly attached in axial and radial direction, with a piston, which is fixedly connected to hollow rods, which can be telescoped, gliding thereon, said piston in turn being supported on the inner wall of the first sleeve half and being able to move from the sleeve base to the open sleeve edge and closing said sleeve edge at that location.

A closed hollow body is always formed by means of the two sleeve halves and is tightly closed in the first state of the sleeve halves, which are placed on top of one another, by means of the piston, so that moisture formed by condensation or umbrella wetness cannot be released. The axial expansion of the tangent cylinder surfaces of the displaceable piston releases large frictional forces with the inner sleeve wall. The moved tight piston creates a pressure or a vacuum in the interior of the sleeve—depending on the direction of movement.

English application GB 2 403 904/Spanish application ES 2 293 292/U.S. patent application US 2006 174 928/International application WO 2005 013 755 describes an umbrella holder or carrier for accommodating a folded umbrella, wherein the holder is provided with fastening or carry loops, which in turn can be placed over or fastened to carry handles of a piece of luggage—such as bags or suitcases. The umbrella carrier is substantially formed as a hollow cylinder and can also encompass ventilation openings.

The umbrella carrier according to the invention is introduced as a part, which is independent of the umbrella.

English application GB 2 320 893 introduces a collapsible and foldable pocket umbrella, in the case of which the folded umbrella is completely accommodated in the umbrella handle. The end of the main rods—the guide rods—which is located opposite to the roof rods is supported in one piece in the base of the hollow-cylindrical handle housing, which is closed by means of a cover, so as to be capable of being rotated about its longitudinal axis. On the second rod section of the main rods—running above the guide rods—a slide or support, the outer diameter of which is adapted to the inner diameter of the handle housing, is attached in one piece at the end of said second rod section, located opposite to the roof rods and displaces in response to the removal of the main and roof rods from the umbrella handle from the base to the opening of the handle housing and stabilizes the axially-rotatable main rods at that location as second support. The handle housing is slightly opened towards the opening in a truncated cone-shaped manner so as to provide for an easier insertion of the rods into the handle housing.

The slide or support as second support in response to the extended main and roof rods has already been the object of foldable umbrellas in industrial property right publications around 1930.

English application GB 365 954 introduces such a foldable umbrella, in the case of which a known umbrella comprising main and roof rods, lining and handle, can be accommodated in a long, small-diameter, foldable and lockable two-shell hollow-cylindrical handle housing so as to be folded, wherein the handle projects outwards from one end of the housing and the umbrella crown projects outwards at the opposite end of the folded housing. The umbrella handle is connected to the one half of the folded housing by means of two narrow guide rails located diametrically opposite to one another such that half of the housing is opened in response to the opening operation, the rail-guided umbrella is removed and faces away from the housing approximately at a right angle and is opened and rotated against the initial position by 180°—as in the case of a carnival swing—and is placed back into the housing half and closed by means of the second cover half. Due to the fact that the handle housing length corresponds approximately to the length of the umbrella, the umbrella, which cannot be folded, is not suitable as a pocket umbrella.

English patent specification GB 311 265 also introduces an umbrella case in combination with a ladies' handbag such that the umbrella can be accommodated in fasteners within the handbag, which are provided for this purpose.

Japanese patent application JP 2002 291 509 introduces a foldable pocket umbrella, which can be telescoped, comprising a water-tight housing and an aid for closing and opening the umbrella. In addition, the umbrella has a reservoir container in the event that water has accumulated in the housing in the case of a wet umbrella. The housing furthermore encompasses a screwable drainage opening.

In the closed state, umbrella knob and housing opening are fixedly screwed to one another; the umbrella is removed from the housing—so as to use it; the housing acts like a packaging. The umbrella shaft is fixedly connected to the knob.

Japanese patent application JP 2000 070 024 also introduces a foldable pocket umbrella, which is completely accommodated in the handle cover in the folded state. The handle cover is embodied in several pieces and substantially consist of two sandwich tube sections—in each case consisting of two cylindrical half shells, which are held in a resilient manner and closed via elastomer connections, with the first tube section, which is farthest away from the roof rods and which has the larger diameter, encompasses a divided base cover, which is formed by one-sided bending of the half shells. On its end facing the roof rods, the second tube section, which is designed in the same manner and which has the smaller diameter, has an edge-hinged cover flap for each half shell, which comprises a center bore hole, which is embodied as an elongate hole towards the edge facing away from the hinge, so that the extended main rods are guided in the center by means thereof when the covers are folded shut. The two multi-piece tube sections, which are inserted into one another and which glide within one another, are connected to one another only at their two open ends in a large-volume manner and being formed to embody an elliptical cylinder and are inserted into one another when the umbrella is extended so as to form a hollow circular cylinder as handle cover, which virtually halves the volume.

Due to the axial and radial volume change in response to the change of state from the empty handle cover housing to the umbrella-accommodating transport housing, the design of the housing constructions is quite extensive. The elliptical transport housing halves, which are resilient in radial direction due to pressure, do not eliminate injuries to the skin of the person carrying it.

Japanese publication JP 5 123 211 introduces a foldable umbrella comprising a handle cover, which is in particular designed for accommodating a wet umbrella lining. The handle cover consists of a cylindrical tube section, which is screwed to a base plate on the base side, which is prepared for a hollow-cylindrical accommodation for the rods; the inserted rods are reinforced in the accommodation so as to be incapable of rotating. At the opposite upper end, the handle cover jacket has an axially short, wall-reinforced recess, which accommodates an internal thread. The cylindrical umbrella cap is screwed to the rods by means of a loose bearing adapter and covers the handle cover via a hollow-cylindrical recess, which has an external thread, which matches the internal thread of the handle cover, for the purpose of tightly screwing the handle cover when the umbrella is folded and inserted, wherein a sealing O-ring is accommodated between umbrella cap and handle cover. Two grip burls arranged outside on the cover periphery of the umbrella cap serve for the handling thereof for unscrewing and screwing. In response to the unpacking and packing, the One umbrella lining of the folded, possibly wet umbrella, is slid into the handle cover in longitudinal direction without a rotation via the sharp-edged interior thread-bearing recess; damage to the lining is possible after repeated use. A second bearing—in addition to the fixed bearing of the handle cover on the base side—is not provided as support for the rods at the upper end of the handle cover.

U.S. publication US 4 821 756 discloses a foldable umbrella, which is completely accommodated in a handle cover in the folded state, wherein the main rods cannot be telescoped and the handle cover length is greater than the greatest length of roof rod or main rods. At their lower end opposite to the roof rods, the main rods have a piston, which is supported in the interior of the handle cover so as to be axially displaceable, which forms a guide cylinder for the main rods. The rods are subjected to a second guiding when leaving the handle cover at the end, which faces the roof rods. For opening the umbrella, main rods and roof rods are pulled out of the handle cover until the roof rods are no longer encompassed by it, the roof rods comprising the lining can then be opened and the main rods can again be pushed so deep into the handle cover that handle cover and roof rods meet. Main rods and roof rods cannot be telescoped, the main rods are secured against being rotated, the umbrella housing is closed tightly; the longitudinal dimensions of the umbrella prevent it from being suitable and used as a pocket umbrella.

U.S. application U.S. Pat. No. 4,456,023 discloses a foldable umbrella comprising rods, which can be telescoped, in a fixedly water-tight cover, in the case of which the tip of the umbrella has a screwable handle cap, by means of which the cover is sealed when the umbrella is inserted. On the cylindrical inner wall, the fixed cover has grooves running in axial direction, in which tongues of the slide of the rods, which can be telescoped, run so as to be secured against rotation in response to the insertion and extending of the umbrella. At the upper end of the inner wall, the longitudinal grooves transfer into radially spiral-shaped screw grooves; the slide of the extended umbrella can thus be locked at the upper cover inner stop by a rotation against the cover.

Due to climate, a tight umbrella housing forms condensation moisture in the interior, which does not drain, also caused by the moisture of an umbrella lining. This solution also provides for only a one-point support for the expanded telescoped rods at the upper cover end.

With publication US 2 091 676, the U.S. Patent Office protected a foldable pocket umbrella, the handle housing of which consists of two inner sleeves, which are arranged within/on top of one another so as to be longitudinally displaceable, and outer tube halves, with the lower base of the sleeve being closed and accommodating the guide tube of the main umbrella rods, which can be telescoped, in one piece and with the opposite cover of the tube half being formed by means of the end cap of the crown of the roof rods and the handle housing closes tightly in the folded state. A closed circular disk-shaped guide is attached via a collar at the lower end of the first rod tube after the guide tube, with said guide gliding to the upper open end of the inner sleeve with the opening of the umbrella or of the main rods, which can be telescoped, respectively, and which closes it in this state on the one hand and which forms the second radial support bearing for the main rods on the other hand. Two longitudinal wedges, which are located opposite one another and which run longitudinally at the inner wall of the inner sleeve, are compatible with two correspondingly attached and molded slits of the guide disks and are to form a security against rotation between inner sleeve and main rods. The security against rotation of the umbrella is only given when the outer handle tube is also secured against rotation against the inner sleeve. The closed guide disk—operating like a piston—seals against the inner wall of the inner sleeve and—depending on the direction of movement—allows for a vacuum to be created in the interior of the sleeve or builds up pressure. Even a slight deformation of the inner sleeve allows for only a limited movement of the guide disk.

Contrary thereto, U.S. application U.S. Pat. No. 1,885,968 shows a one-point support for the main rods in the handle housing, which accommodates the umbrella, by means of a piston comprising a tongue, which points in radial direction projecting beyond the outer diameter thereof and which glides in a groove, which runs spirally in axial direction via the cylindrical inner wall of the handle housing and which thus causes the piston to roll during an axial displacement. The rolling causes a relative movement between the folded umbrella and the inner wall of the handle housing in response to the extension and insertion of the umbrella, so as to securely position the umbrella lining and the frame, wherein an increased friction takes place between handle housing and piston.

Contrary thereto, U.S. application U.S. Pat. No. 892,813 shows a one-point support for the main rods in the handle, which is in the base point or at the top of the case, depending on the expansion of the umbrella and position of the rods.

U.S. application U.S. Pat. No. 868,326 also shows a foldable umbrella comprising an umbrella case, in the case of which the stability of the main rods is only given in a base point support for the handle/case.

International application WO 1997/048 303 "Combined Umbrella Case and Handle" introduces a hollow-cylindrical umbrella handle, which can be screwed to a cover, wherein the cylindrical cover is slit across the width of the main rods across a radius and the umbrella handle—when being filled with a foldable umbrella—is closed by means of the cover screw connection and the screwed cover—when the umbrella is extended—has an aperture and a lock for the main rods for the two-point support. At its edge, the cover extending beyond the handle cover has an internal thread, which is designed so as to match the external thread of the handle cover. Towards the rod outlet, the cover is furthermore designed by a port comprising a protruding collar, over which a clamp is placed, which is also slit to rod dimensions, which closes the slit opening by rotation and which forms the above-mentioned second support next to the fixed bearing in the handle cover base when the foldable umbrella is extended. A further embodiment describes a fixedly installed rotary slide comprising a small handle button, which can be activated by hand, instead of the rotary clamp, which is attached by means of a cord and which is placed loosely on top. A further embodiment shows a slit flap cover, which is hinged to the cover edge and which is held by means of a locking device, which is to be operated by hand in the closed position. In a first solution, the handle cover encompasses an open base, which is bordered in radial direction, where the main rods are fixedly supported by means of two large diameter washers or—in a second approach—a closed base comprising a centrally placed bolt or stud, via which the main rods are fixed. The screw cover solution comprising rotary clamp or detent cover comprising a rotary clamp as solution for the further bearing point for the main rods loses points in its sense of value—the wide cover slit for the rods provides for an opening, which is too large. The main rods are attached in the base of the handle cover in one piece.

All of the presented publications are only conditionally suitable or not suitable at all for the specific use as foldable umbrella comprising an additional further functionality, such as an umbrella cover—in particular not for a compact pocket umbrella comprising a handle cover and support for rotatable and lockable main rods with double bearings.

SUMMARY OF THE INVENTION

It is thus the object of the invention to create a device according to the preamble of claim 1, a foldable umbrella comprising an additional further functionality, such as an umbrella cover—in particular a compact pocket umbrella comprising a handle cover and support for rotatable and lockable main rods with double bearings.

This object is solved according to the invention by means of the characterizing features of claim 1; the subclaims refer to advantageous embodiments. The goal is the design of a foldable pocket umbrella comprising an additional further functionality, such as an umbrella cover—in particular a compact pocket umbrella comprising a handle cover and support for rotatable and lockable main rods with double bearings. The handle cover, which is preferably embodied as a hollow cylinder, is embodied such that it can completely accommodate the umbrella, which consists substantially of guide tube, support element, main rods, main and auxiliary slide, roof crown, roof rods and lining, by means of folding and pushing together. A quick handling by the user is provided via an easily accessible, preferably also disk-shaped extractable handle, which is fixedly connected to the main rods, so as to be flush, towards the roof crown and clamp.

The combination of guide tube, support element, main rods and main and auxiliary slide represents a further advantageous design of the novelty according to the invention in that the support element provides stability to the arrangement—but also a certain resilience—due to its truncated cone-shaped design and its tripod slide bearing and compliance in each position of the extended main rods.

A further advantageous embodiment of the invention is provided in that provision is made for a ventilation of the interior, which is filled with the roof rods and the lining, and that an accumulation of moisture is prevented by means of the bilateral opening of the handle cover of the umbrella at the top and base side—on the top side by means of the rotating annulus-forming space maintainers between handle cover collar and extractable handle, and on the base side by means of narrow slits or bore holes in the disk-shaped base plate or also by means of a rotating, annulus-forming space maintainer between handle cover collar and base cover.

An approximately similar design of cover and base part comprising the accommodation of the roof crown of the main rods on the one side and the rotary bearing for the guide rods on the other side aids in reducing the tool costs and the number of parts.

The advantages, which can be attained by means of the invention, lie in particular in the design of a preferably spatially truncated cone-shaped tripod of the support element, which is preferably fixedly connected to the lower end of the first tube section—after the guide tube—of the main rods. On the one hand, the embodiment of the resilient slide bearing within the handle cover does not allow for a full cross sectional surface design of the support element. On the other hand, the embodiment of the support element as tripod provides free space for air ducts of the ventilated interior handle cover.

A three-point bearing of the guide tube and of the main rods—and thus of the umbrella load—is furthermore optimal, based on secured stability on the one hand and on minimal frictional losses between support element and inner wall of the handle cover in response to the extending and insertion of the support element, which is preferably fixedly connected to the lower end of the first tube section—after the guide tube—of the main rods, on the other hand.

A further advantage in the embodiment of the invention lies in the ergonomic and advertising embodiment of the handle cover; the preferably hollow-cylindrical design of the aluminum body fits well into the hand of the user, imparts a special sense of the value to the person, who carries it, due to the high-quality materials and provides for an ideal advertising medium even when the lining is not open.

According to a further design alternative, the torsion-resistant main rods in combination with the guide tube are characterized so as to preferably be embodied in a polygonal manner and do not allow for torsion in this area.

The guide tube, which preferably has a polygonal cross sectional shape, is connected to the handle cover via a correspondingly molded, encased standpipe cone in the form of a loose bearing in a stationary and rotatable manner, but engages in a rotationally secure manner in its end position.

The rotatability in response to the insertion of the folded umbrella into the handle cover represents an advantageous umbrella inserting aid for the person, who carries the umbrella, so as not to cause any injuries to human and material even in response to a hurried packaging of guide tube, support element, main and auxiliary slide, roof crown, roof rods and lining by folding and pushing together into the handle cover.

A further advantageous embodiment of the invention furthermore lies in the accessibility of the user to the extractable handle for the purpose of opening the umbrella, in that a rotary, crown-forming space maintainer between handle cover collar and extractable handle provides for ample space for the manual handling.

The combination of rotatability when the umbrella rods are extended and rotationally secure fit in the inserted state provides advantages to the user or person, who carries the umbrella, in that a free run is provided on the one hand in response to a high wind force or in response to the striking of the roof rod tips, whereby damages to the lining and/or to the guide rods in the fixed bearing are avoided and a risk of injury to the person, who carries the umbrella, is reduced and handle cover and rods form a compact inherently stable unit on the other hand.

The object of the invention will be illustrated in more detail below by means of the drawings of exemplary embodiments, which are enclosed.

BRIEF DESCRIPTION OF THE DRAWING

The same components of the exemplary embodiments and components having the same effects are in each case provided with the same reference numerals in the figures.

The description of the device according to the invention is continued by means of the description of the figures.

DETAILED DESCRIPTION OF PREFERRED EMBODIMENTS

Figure 1:
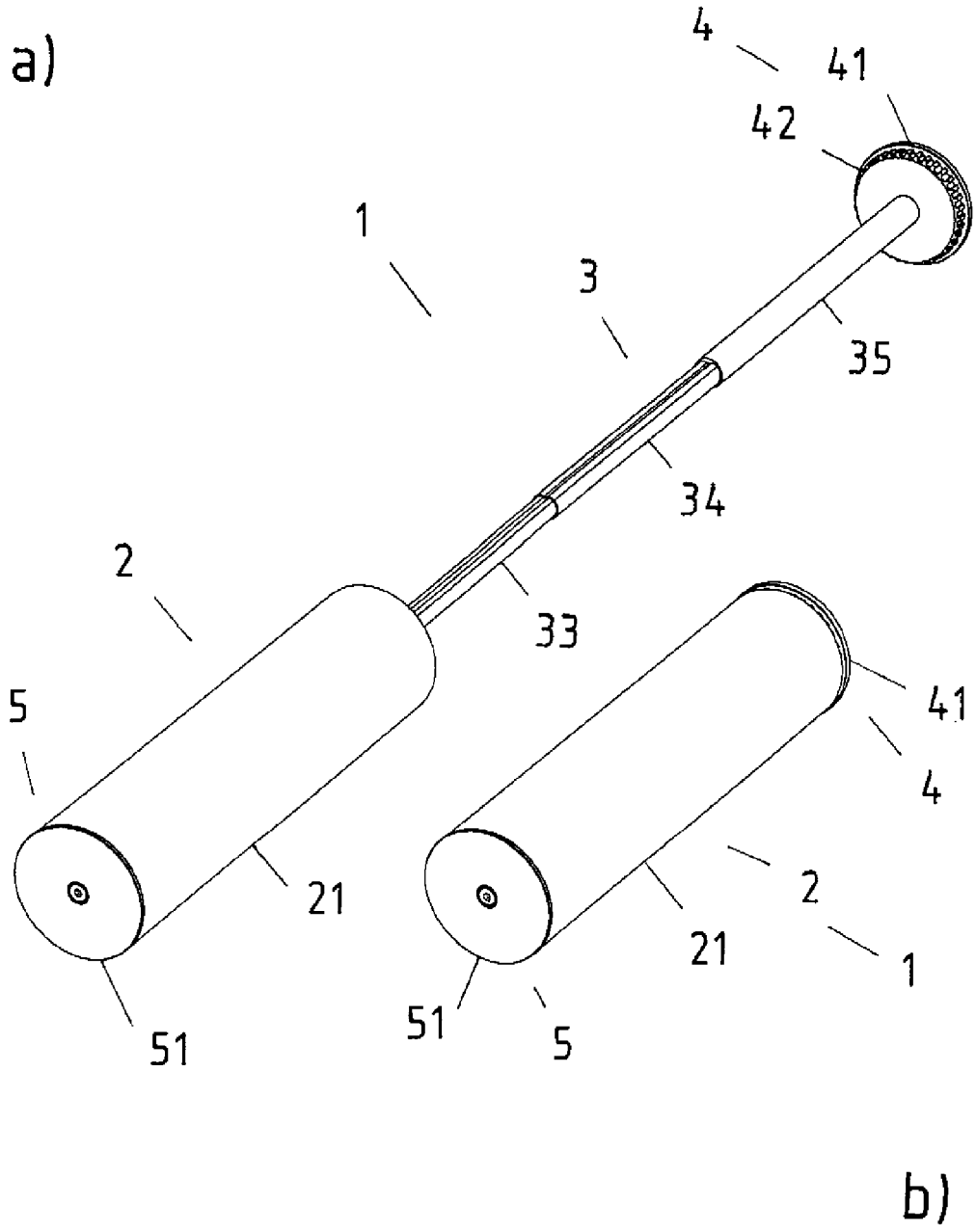
FIG. 1 shows a pocket umbrella, overall view without slide, roof rods, lining, perspective view
a) extended state
b) inserted state

FIG. 1 shows, in a perspective illustration, the compact pocket umbrella 1 without main and auxiliary slide, without roof rods and without lining, consisting of handle cover 2, preferably as metallic hollow cylinder 21, main rods 3, umbrella top 4, consisting of extractable handle 41 and lamella annulus 42 and base point bearing 5, comprising cover 51, in FIG. 1*a*) comprising extended main rods 3 and the tube sections 1 33, tube section 2 34 and tube section 3 35. For reasons of clarity, roof rods 7 and lining 8 were not illustrated. A robust hollow cylinder having a thin wall thickness of aluminum is preferably proposed as body for the handle cover, if necessary comprising refined, anodized, colored surface.

FIG. 1*b*) shows the compact pocket umbrella 1 comprising handle cover 2, 21, umbrella top 4, 41 and base point bearing 5, 51 in the inserted state in perspective illustration. In this state, main rods, support element, main and auxiliary slide, roof crown, roof rods and lining are completely installed in the handle cover. The surface 21 is preferably suitable as advertising medium—in particular also when the umbrella is not open.

Figure 2:
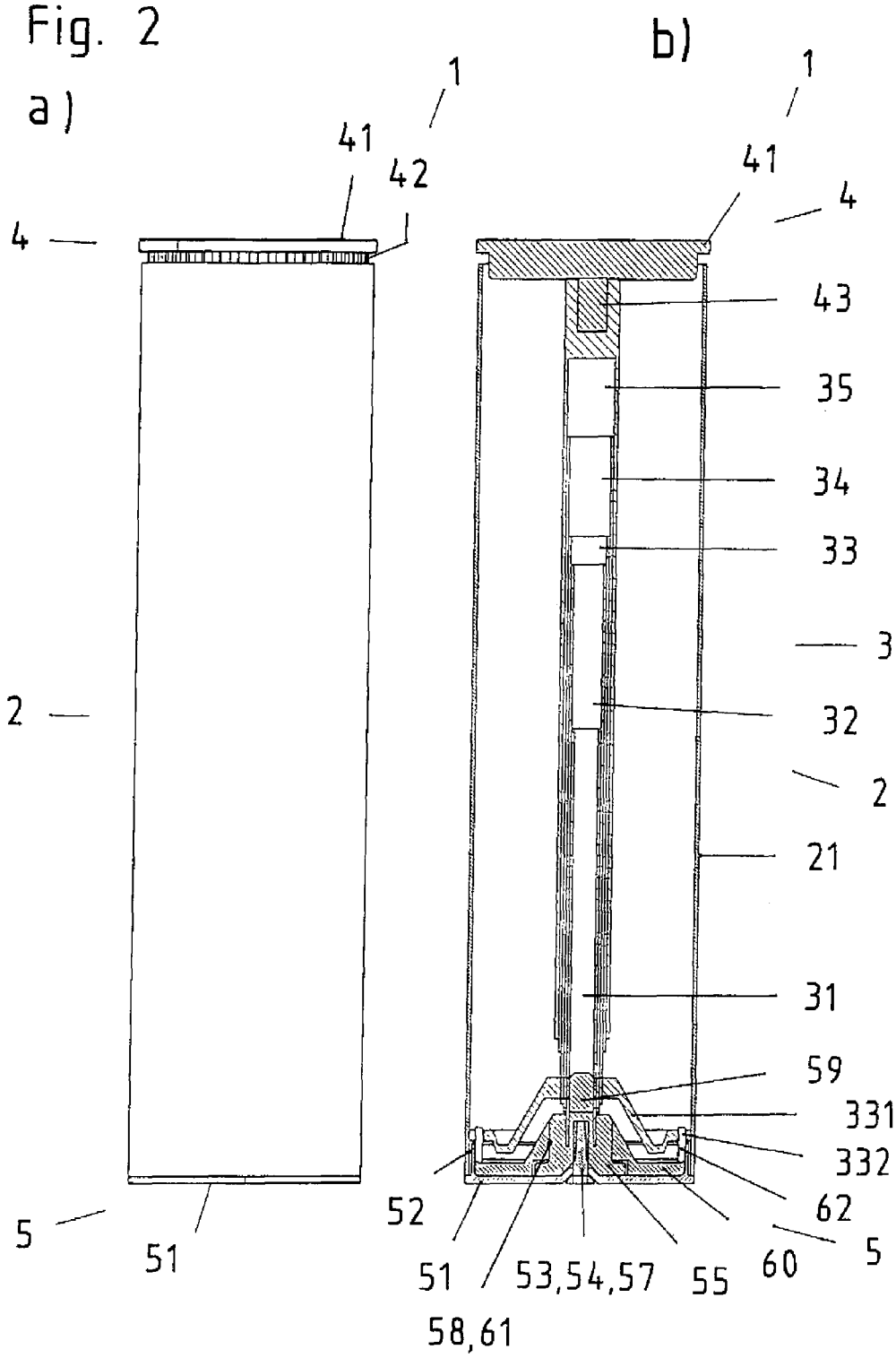
FIG. 2 shows a pocket umbrella, inserted state
a) side view
b) sectional illustration

FIG. 2 shows the compact pocket umbrella 1 in the inserted state, in FIG. 2*a*) as side view and in FIG. 2*b*) as sectional illustration. The embodiment of the lamella annulus 42, which is created for the ventilation and the handling, and which is connected in one piece to the extractable handle 41 and to the roof crown 43 located therebelow, can clearly be seen. The lamella annulus consists of ribs, which are arranged across the diameter at the same distance in axial direction, the longitudinal expansion of which are characterized in two stages. In a first stage, a distance serving as air gap is established in longitudinal direction between handle cover upper edge and extractable handle projection and the expansion of the ribs in radial direction furthermore corresponds to the inner diameter of the handle cover. Through this, m air vents are created between the ribs and the inner wall of the handle cover in response to a number of m ribs.

Both openings of the hollow-cylindrical handle cover 2, 21 are covered; the handle cover completely accommodates the guide tubes 1, 2 31, 32, which are pushed together, and the tube sections 1, 2, 3 33, 34, 35 of the main rods 3 comprising the support element 331. In this context, the support element is held in a rotationally secure manner by means of the locking pins 62 of the counter bearing 60. In the event that the locking pins are embodied as engagement hooks, the opening of the umbrella 1 only takes place in a force-guided manner. The base point bearing 5 consists of a cover 51, 52 which is attached to the hollow body 21 in one piece and which, in turn, is connected to the counter bearing 60 in one piece and which accommodates the rotary bearing 55 between it and the base cover, with said rotary bearing 55 being fixed by means of an accommodation 53, a fastening means 54 and a centering device 57. Rotary bearing and counter bearing have the contact surfaces 58, 61 in common. The guide tube 1 31 of the main rods 3 is connected to the rotary bearing in one piece; due to the fact that all of the tubes and sections of the main rods are connected by means of rotationally secure tubes, the locking pins of the fixed counter bearing secure the support element via the radial slit 332, the support element acts on all of the tubes and sections and the extractable handle 41 via the tube section 1 in a rotationally secure manner and also acts on the rotary bearing 55 via the guide tubes 1, 2, 32, 33.

To open the umbrella, the extractable handle must initially be pulled axially until the locking pins of the counter bearing release the radial slits of the support element; the lined umbrella can then be removed by means of slightly rotating/pulling the handle cover. In its spatial design, the support element 331 with the dome 335 follows the truncated cone-shaped design of the rotary bearing 55 and counter bearing 60 and thus attains the required stiffness in addition to the necessary resilience.

Figure 3:
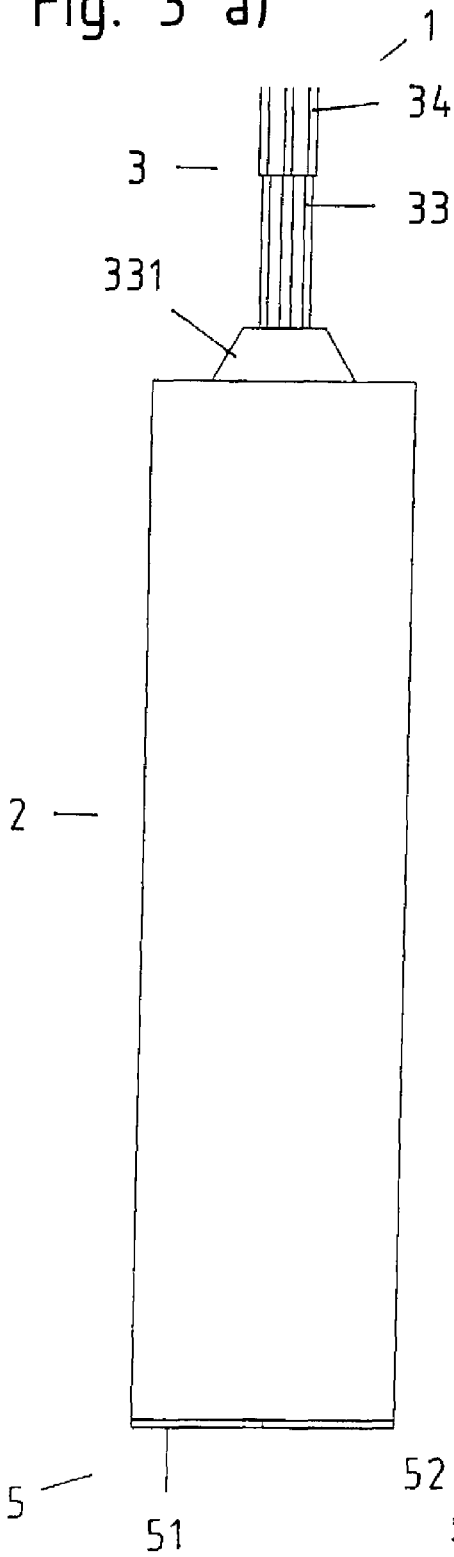
FIG. 3 shows a pocket umbrella, extended state, partial view
a) side view
b) sectional illustration
Figure 3:
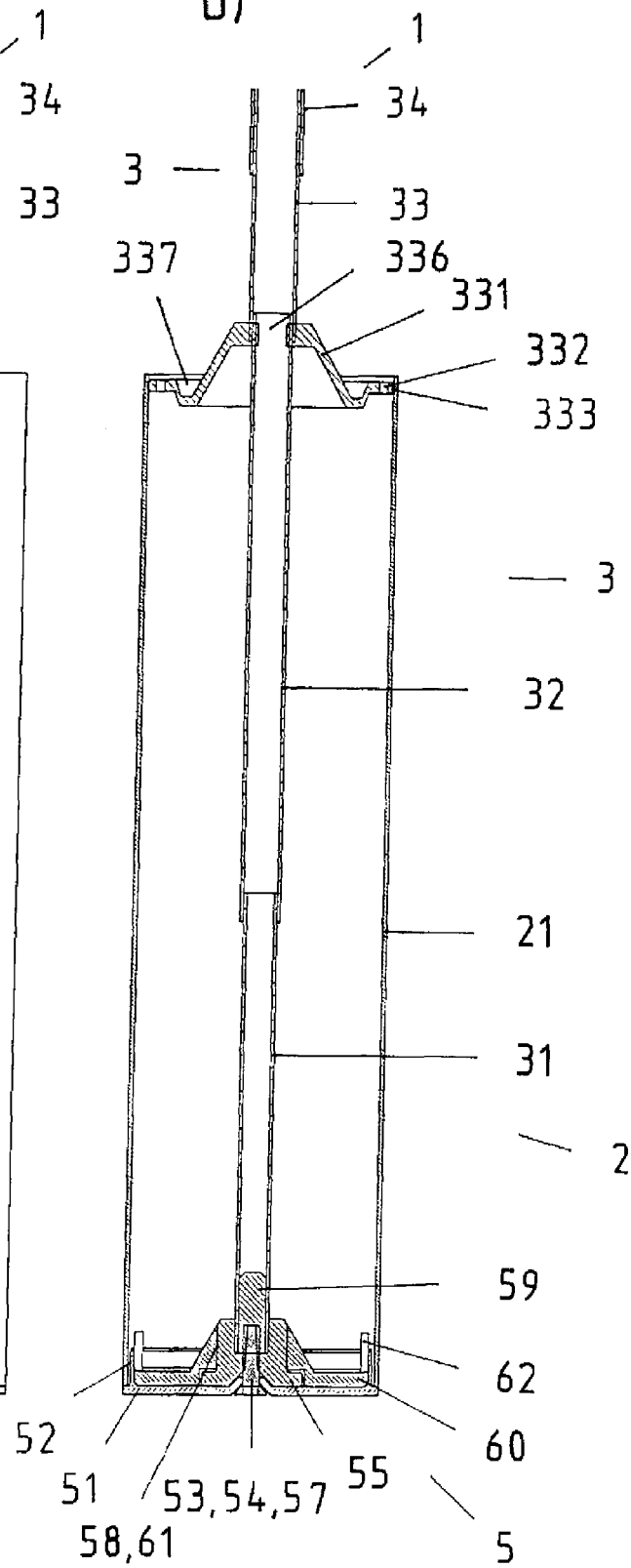

FIG. 3 shows the compact pocket umbrella 1 in the extended state as partial view, namely in FIG. 3*a*) as side view and in FIG. 3*b*) as sectional illustration. The support element 331 closes the opening of the hollow cylinder 21 of the handle cover 2, which faces the roof crown 43 most closely. The tube sections 1, 2 33, 34 are connected to the guide tubes 1, 2 31, 32 in a rotationally secure manner and the guide tube 1 has a fixed connection via the journal 59 to the rotary bearing 55, which can move in a freely rotatable manner in the counter bearing 60 when the umbrella is open, so that external influences on roof rods 7 (not illustrated) and umbrella lining 8 (not illustrated)—such as bumping of the umbrella or strong gusts of wind—do not have any damaging or destructive impact on it.

Figure 4:
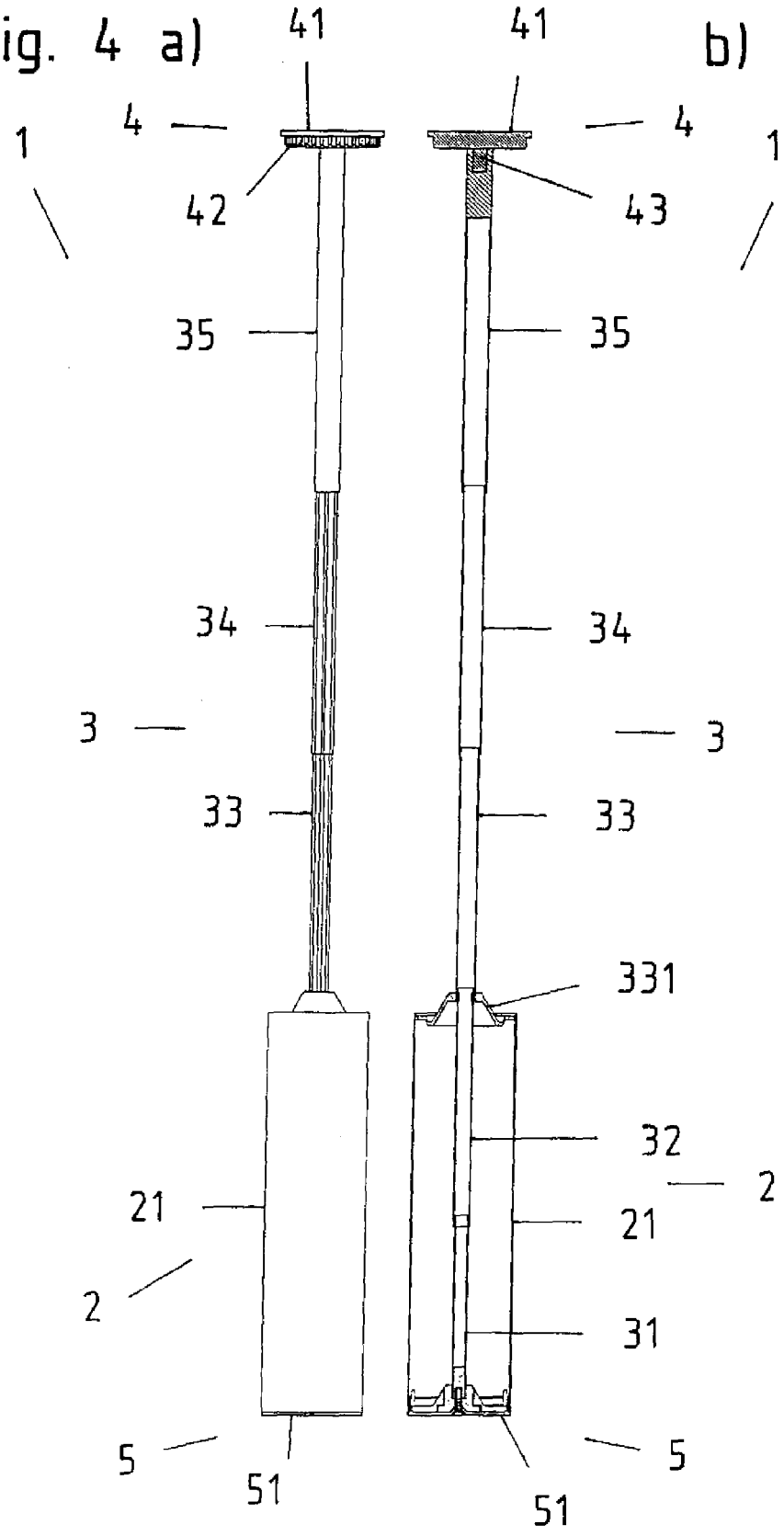
FIG. 4 shows a pocket umbrella, extended state, overall view
a) side view
b) sectional illustration

FIG. 4 shows the overall view of the pocket umbrella 1 in the extended state, in FIG. 4*a*) as side view and in FIG. 4*b*) as sectional illustration, and clarifies the complete design of the main rods 3 comprising guide tubes 1, 2 31, 32 and tube sections 1, 2, 3 33, 34, 35.

Figure 5:
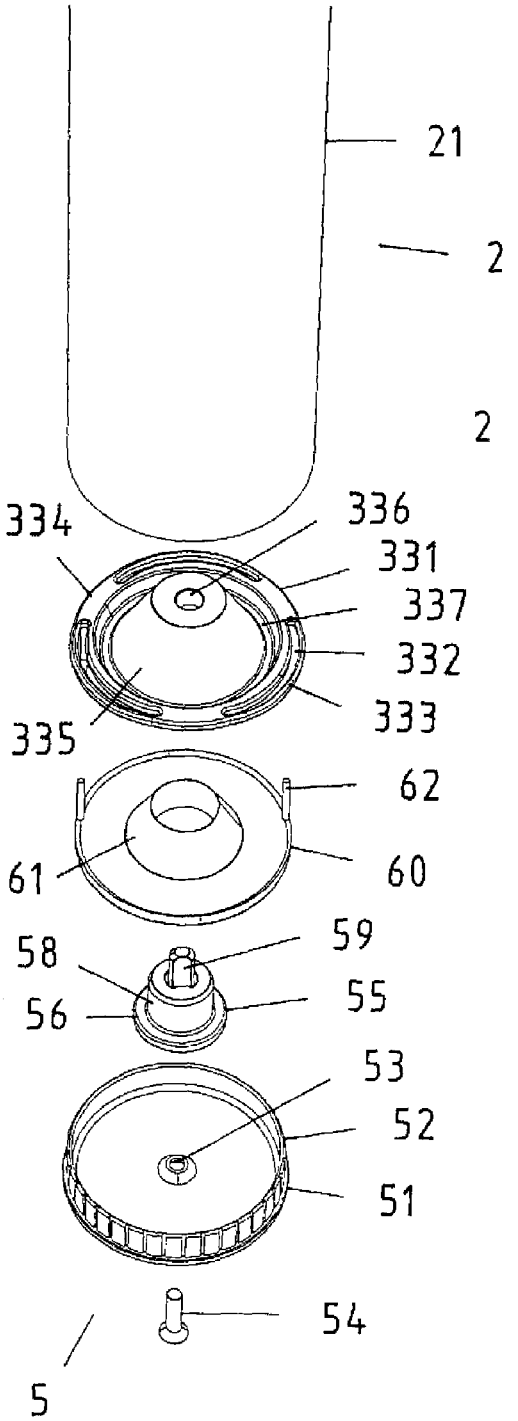
FIG. 5 shows a base point bearing and support element, exploded illustration
a) perspective view
b) sectional illustration
Figure 5:
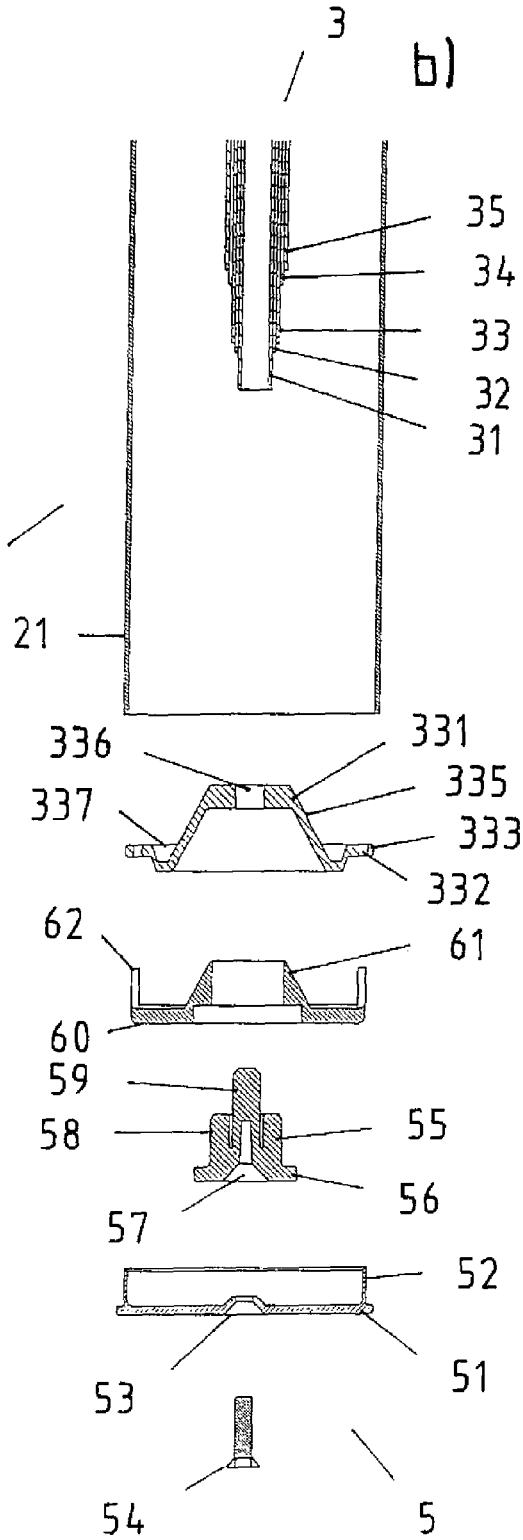

FIG. 5 clarifies the design of the base point bearing 5, with the support element 331 in an exploded illustration, in FIG. 5*a*) in a perspective view and in FIG. 5*b*) as a component part sectional illustration. The base point bearing substantially consists of the plastic cover 51 comprising the molded fastener 52 and an accommodation 53. The diameter of the cover fastener is dimensioned such that it is adhered in one piece to the handle cover 2, 21 in the case of a tight fit in the lower opening of said handle cover 2, 21. For the ventilation of the handle cover, the plastic cover can be provided with slits or bore holes 63 or also with a lamella annulus formed of individual ribs (not illustrated), as is already embodied in the upper cover opening; in this case, the lugs of the illustrated cover fastening are embodied in ribs, but silhouetted from the embodiment of the extractable handle 41. It is important for the tight fit of the cover that it can accommodate all of the forces acting on the umbrella.

The rotary bearing 55 is in close contact with the cover accommodation. This plastic part has a plurality of functions; it accommodates the guide tube 1 31 in a rotationally secure manner via the notched journal 59; it supports the main rods 3 on the bottom cover in a rotary manner by means of the bearing 56 and forms the connection to the fixed plastic counter bearing 60 width the cylinder surface of the bearing cup 58. The counter bearing is ultrasonically welded in one piece or adhered to the base cover, wherein the bearing cup 61 first accommodates the rotary bearing 55. Constructively, the counter bearing can also be connected to the base cover and to the handle cover via a force fit. The counter bearing furthermore has molded locking pins 62, which accommodate the support element 331 in the inserted state of the pocket umbrella. These locking pins can also be embodied as engagement hooks with corresponding embodiment of accommodations in the support element, so that an unlocking of counter bearing and support element initially takes place via a tractive force via the extractable handle 41 for opening the umbrella, before the umbrella parts rods and lining are possibly removed by slightly rotating or rolling the handle cover. Constructive alternatives are also appropriate at this point. The support elements bundles the rod tips via the accommodation 337 when the umbrella 1 is folded and inserted.

Figure 6:
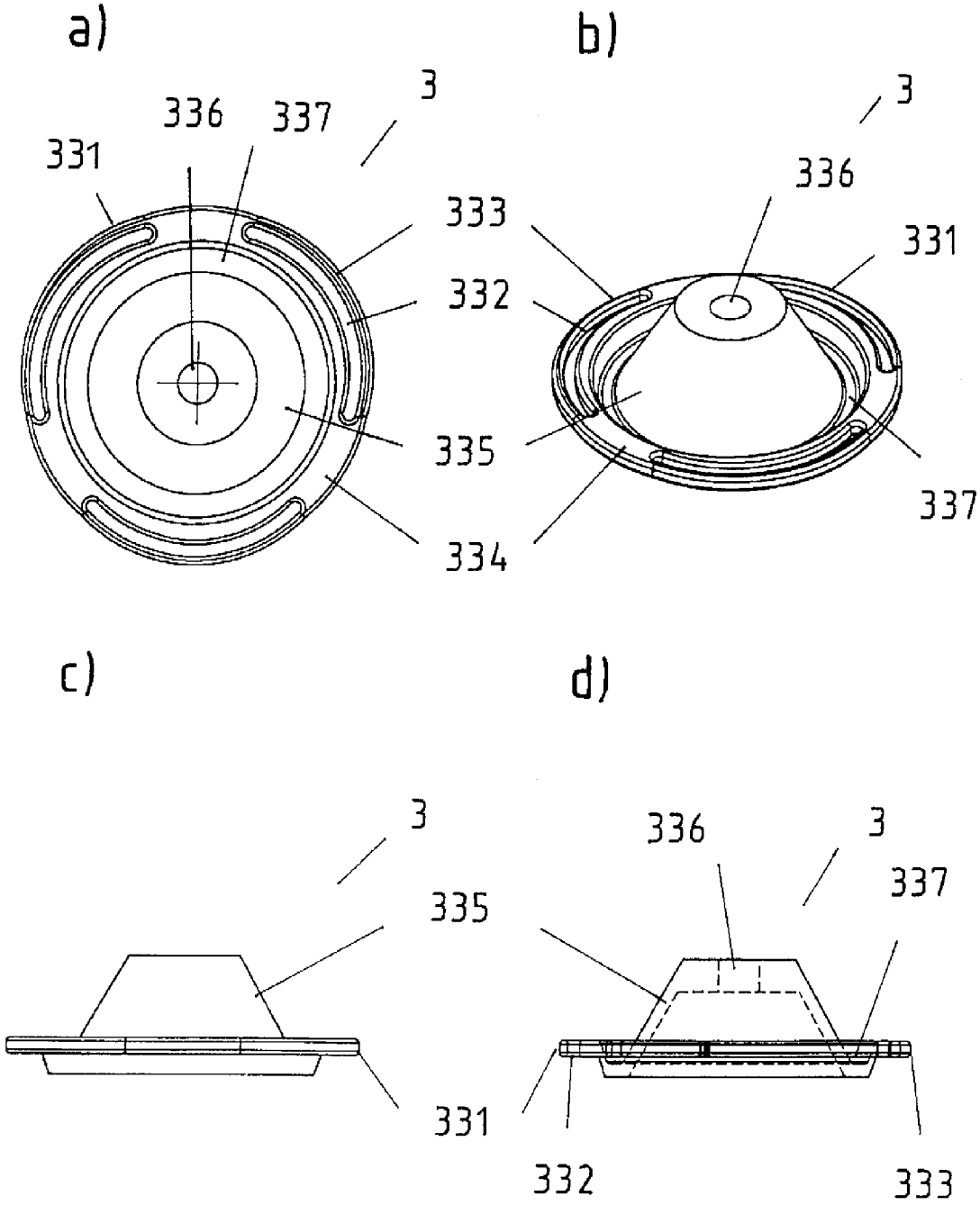
FIG. 6 shows a support element, component part
a) top view
b) perspective view
c) side view
d) sectional illustration.

FIG. 6 shows the support element 331 as component part, in FIG. 6*a*) in top view, in FIG. 6*b*) in perspective illustration, in FIG. 6*c*) in side view and in FIG. 6*d*) as sectional illustration. At the lower end of the tube section 1 33 of the main rods 3, the support element is mounted in one piece via the tube accommodation 336, displaces in the interior of the hollow cylinder 21 of the handle cover 2 between base point bearing 5 when the umbrella is inserted and upper handle cover edge when the umbrella is extended, and forms—in this state—the second support for the main rods next to the base point bearing. The body of the support element is substantially embodied as a dome 335 in a truncated cone-shaped manner, adapts to the design of the bearing cup 61 of the counter bearing 60, also has a truncated cone-shaped depression 337 towards the edge, which accommodated the roof rod tips when the umbrella 1 is folded and inserted. The edge of the support element, which is expanded in radial direction, is designed in a multi-functional manner; the edge is divided into zones comprising a 120°-division—according to the illustration—namely alternately into a support zone 334, a spring guide 333 and a ventilation zone 332. Under the freely chosen 120° division—other divisions are also possible—the support zones form a static tripod having a material throughput, which substantially accommodates the radial forces emanating from the lined roof construction and which are transferred via the main rods and transfers those forces and the axial forces together with the base point bearing 5 onto the hollow-cylindrical handle cover 2, 21. The outer dimensions of the tripod are tolerated in a minimally undersized manner as compared to the hollow cylinder inner diameter.

A spring guide and a ventilation zone follow the support zones in each case. Due to the undercut of the support element edge, this area acts as spring element as compared to the inner wall of the hollow cylinder 21. In the case of a slight radial oversize as compared to corresponding dimensions of the support zone, the spring guide zones always abut on the hollow cylinder inner wall, yield slightly in response to the application of radial forces until the support zone contacts the inner wall. In response to the extension and insertion of the main rods, the springs glide across the hollow cylinder inner wall 21. In the illustrations according to the figures, the undercut of the support element edge is projected as a radial slit, which runs parallel; an elliptical, hyperbolic, parabolic or non-parallel undercut can additionally support the spring effect—also as a function of the material selection. However, the double truncated cone sequence dome 335 and accommodation 337—from the tube accommodation 336 to the outer diameter of the support element additionally lends the support zone the characteristics of a spring. On the one hand, the embodiment of the resilient slide bearing 333 within the handle cover 2 does not allow for a full cross sectional surface design of the support element 331. On the other hand, this embodiment of the support element as tripod provides free space for air ducts 332 for the circulation of the ventilated interior handle cover and thus ensures the pressure compensation in response to the displacing of the support element.

While the invention has been illustrated and described as embodied in a pocket umbrella, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A compact pocket umbrella comprising:

a handle cover connected to an umbrella top, a base point bearing attached to one end of the handle cover, a handle attached to the umbrella top, and a cylindrical multi-function support element for movement within the handle cover along a main rod for resiliently stabilizing the umbrella, wherein the main rod comprises a plurality of tube sections telescoped one in the other with the multi-function support connected to one of the tube sections for movement via a tube accommodation, wherein the multi-function support element is constructed as a one-piece truncated cone-shape dome open towards a base cover followed by a truncated dome-shaped accommodation element open in direction opposite the base cover, whose outermost journal transfers into a multi-part, multi-function angle-dependent edge expanded horizontally in a circular manner and divided into a plurality of zones comprising support zones and adjacent spring guide zones, followed by a ventilation zone by means of an axial undercut.

2. The compact pocket umbrella of claim 1, wherein at a predetermined angle of a 120° of the multi-part, multi-function edge, the support zones form a static material tripod.

3. The compact pocket umbrella of claim 1, wherein an outer diameter of a spring guide zone includes a radial overdimension as compared to a respective dimension of the support zone according to an inner diameter of the handle cover.

4. The compact pocket umbrella of claim 1, wherein each of the spring guide zones are formed by the undercut of the multi-function edge whereby the ventilation zone is realized.

5. The compact pocket umbrella of claim 1, wherein the spring guide zone has a characteristic line which is determined by an outline of the undercut which is a parallel, parabolic, elliptical, hyperbolic or orthogonal cut.

6. The compact pocket umbrella of claim 1, wherein the spring guide zone has a characteristic contour which is determined by selection of a specific material.

7. The compact pocket umbrella of claim 1, wherein the truncated dome sequence of the dome and the truncated dome-shaped accommodation element confers additional resilient characteristics to the support zones through selection of specific material for the support element.

8. The compact pocket umbrella of claim 1, wherein the main rod and sections connected in a rotationally secure manner are supported in a rotational manner to a counter bearing of the base point bearing via a rotary bearing connected in one piece to a guide tube.

9. The compact pocket umbrella of claim 8, wherein the counter bearing of the base point bearing includes locking pins positioned in corresponding bores in the ventilation zone for securing the main rod against rotation.

10. The compact pocket umbrella of claim 9, wherein the locking pins include engagement hooks or latches for locking with corresponding accommodations thereby securing the support in axial direction against rotation.

* * * * *